US006056480A

United States Patent [19]

Kolk

[11] Patent Number: 6,056,480

[45] Date of Patent: May 2, 2000

[54] SUPPORT FOR UNDERGROUND MINING AND TUNNEL CONSTRUCTION

[76] Inventor: Theodor Kolk, Blickpunkt 21, Haltern-Sythen, Germany, D-45721

[21] Appl. No.: 09/221,409

[22] Filed: Dec. 28, 1998

Related U.S. Application Data

[63] Continuation-in-part of application No. 08/875,643, Jul. 31, 1997, Pat. No. 5,921,718, which is a continuation-in-part of application No. PCT/EP96/01634, Apr. 19, 1996.

[30] Foreign Application Priority Data

Apr. 20, 1995 [DE] Germany ..... 195 14 137

[51] Int. Cl.[7] ..... E21D 25/14; E21D 23/04

[52] U.S. Cl. ..... 405/290; 248/354.2; 405/288

[58] Field of Search ..... 405/288, 289, 405/290, 303, 229, 230; 248/354.2, 354.1, 354.3

[56] References Cited

U.S. PATENT DOCUMENTS

| | | | |
|---|---|---|---|
| 4,167,361 | 9/1979 | Petro et al. | 405/289 X |
| 4,726,714 | 2/1988 | MacArthur | 405/290 |
| 5,143,340 | 9/1992 | Wood et al. | 405/289 |
| 5,165,824 | 11/1992 | Corcoran et al. | 405/288 |
| 5,413,436 | 5/1995 | Merz | 405/290 |
| 5,564,867 | 10/1996 | Domanski et al. | 405/290 |
| 5,720,581 | 2/1998 | Dacon et al. | 405/288 |
| 5,868,527 | 2/1999 | King et al. | 405/288 X |
| 5,921,718 | 7/1999 | Kolk | 405/288 X |

*Primary Examiner*—Dennis L. Taylor
*Attorney, Agent, or Firm*—Collard & Roe, PC

[57] ABSTRACT

There is a support for underground mining and tunnel construction, comprising an outer tube and an inner tube, which can be pushed into each other in a telescoping manner. A piston acted upon by a hydraulic pressure medium is located in the outer tube. This piston, when acted upon by pressure, acts on the inner tube to cause an extension. The outer tube and the inner tube can be fixed on each other by means of a mechanical locking device.

4 Claims, 3 Drawing Sheets

SUPPORT FOR UNDERGROUND MINING AND TUNNEL CONSTRUCTION

CROSS-REFERENCE TO RELATED APPLICATION

This is a continuation-in-part of application Ser. No. 08/875,643 filed on Jul. 31, 1997, now U.S. Pat. No. 5,921,718 International Application PCT/EP96/01634 filed on Apr. 19, 1996 and which designated the U.S.

BACKGROUND OF THE INVENTION

1. Field of the Invention

The present invention relates to a support for underground mining and tunnel construction, comprising an outer tube and an inner tube, which can be pushed into each other in a telescoping manner. A piston acted upon by a hydraulic pressure medium is located in the outer tube. This piston, when acted upon by pressure, acts on the inner tube to cause an extension. The outer tube and the inner tube can be fixed on each other by means of a mechanical locking device.

2. The Prior Art

Such supports are described in the prior art according to WO 94/27029. With the support known according to the state of the art, the mechanical locking device is designed in the form of an annular wedge. This wedge rests against the outer side of the inner tube and which is insertable in the outer tube, the portal side of the outer tube being conically widened for this purpose. The annular wedge is provided with engagement elements on the inside, which dig into the material of the inner tube and deform the inner tube if the forces acting on the support are sufficiently high. It is possible in this way to maintain a relatively high supporting force over a large depth of sinking-in with the mechanical locking device alone. Thus it is not necessary to have to depend on hydraulically generated supporting forces.

A disadvantage of this known support is that the mechanical locking device always first requires a defined depth of sinking-in, or penetration, before it develops its full supporting force. This has the result that after the support has been set and the hydraulic supporting force has been removed, or canceled, there is always a gap in the supporting force. This gap exists until the support has sunk to such an extent that the mechanical locking device is fully supportive.

SUMMARY OF THE INVENTION

It is an object of the invention to provide a remedy for the above disadvantages. It is also an object to develop a support for underground mining and tunneling in such a way that the mechanical locking device is fully carrying the load from the beginning and, if need be, over the entire distance of insertion.

The above object is achieved according to the present invention. The invention provides that on the support of the type specified above, that the mechanical locking device is arranged in a force transmitting manner between the piston and the inside end of the inner tube. The locking device is constructed as an annular, spreading wedge-type drive mechanism having two annular wedge elements that can be pushed into each other axially over a limited distance of displacement. One of these wedge elements is supported on the piston and the other wedge element is supported on the inside end of the inner tube. One of the annular wedge elements rests against the inner circumference of the outer tube and is radially spread open by wedge action at the end of the axial path of displacement of the two annular wedge elements relative to each other. This occurs in a way such that the abutting areas of the wall of the outer tube are outwardly and radially deformed.

With the support, according to the invention, the mechanical locking device is positioned in the path of transmission of force between the piston and the inside end of the inner tube. It is activated by the setting forces applied hydraulically as the support is being set. The mechanical locking device employed with the support as defined by the invention consequently carries the load immediately after setting of the support has been completed. It is not dependent upon any path of sinking-in, or penetration.

A further advantage is that with the support, according to the invention, activation of the mechanical locking device can be seen from the outside. This is because after the setting process has been completed, the outer tube is visibly deformed outwardly within the zone of the radially spread annular wedge element.

As the convergence of the supported sheets of rock progresses, the support, according to the invention, can sink in further while the mechanical locking device remains active over the entire path of sink-in or penetration. Also, the widened zone of the outer tube shifts downwardly over the distance of sinking-in. Therefore, it is possible at any time by observing the outside of the outer tube, to ascertain the distance over which the support has sunk in during the interim.

In a further embodiment of the invention, the inner tube and the outer tube can be filled with construction material after the locking device has been activated. The support can be reinforced in this way in a controlled manner.

In a particularly preferred embodiment of the support of the invention, provision is made that the piston acting on the inner tube is constructed in the form of a flying structural component. This component can be pushed back up to the end of the outer tube under the pressure of the construction material as this material is being filled into the inner tube. It is possible with this embodiment to fill the entire support, i.e., both the inner and the outer tube over the entire length, with construction material in one single filling process. Such filling can be carried out at any time, i.e., immediately after the support has been set, or only after the support has sunk in over a certain distance of convergence under the influence of the weight of the rock. The support so filled with construction material over its entire length assures a maximum supporting force.

BRIEF DESCRIPTION OF THE DRAWINGS

Other objects and features of the present invention will become apparent from the following detailed description considered in connection with the accompanying drawings which disclose several embodiments of the present invention. It should be understood, however, that the drawings are designed for the purpose of illustration only and not as a definition of the limits of the invention.

In the drawings, wherein similar reference characters denote similar elements throughout the several views:

FIG. 4 shows the support of FIG. 3 after a certain distance of penetration or sinking-in;

FIG. 8 shows the support of FIG. 7 after a certain distance of sinking-in.

DETAILED DESCRIPTION OF PREFERRED EMBODIMENTS

Figure 3:
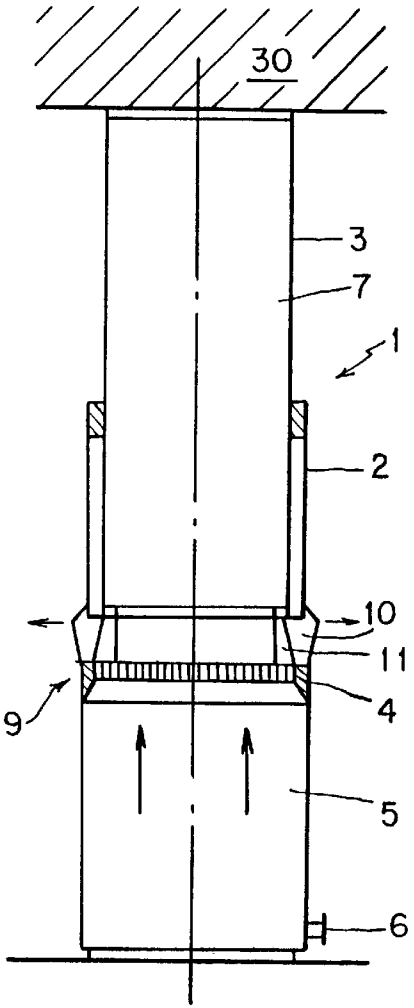
FIG. 3 shows the support of FIG. 2 following activation of the mechanical locking device.

Turning now in detail to the drawings, each of the supports is denoted as a whole by reference numeral 1. Each support has an outer tube 2, which is closed at the bottom end 20 and open at the top end 22. There is an inner tube 3, which is guided in the outer tube. The inner tube is open at the bottom end 24 and closed at the top end 26 and is extendible from the outer tube. Inner tube 3 can be pushed upwardly and out of outer tube 2 by means of a piston 4, which is sealingly guided in the outer tube 2. A first chamber or bottom chamber 5 is located in outer tube 2 below piston 4. A suitable pressure medium, for example pressurized water, can be admitted into the bottom chamber via a filling connection 6.

A second chamber or top chamber 7 is located above piston 4; and the second chamber is substantially formed by inner tube 3.

A mechanical locking device 9 is located in the path of force transmission between piston 4 and the bottom end 24 of the inner tube 3. With the help of this locking device, it is possible to fix or secure the inner tube on the outer tube at any length of extension of the inner tube.

The mechanical locking device 9 has a first annular wedge element 10 supported on the inner end of inner tube 3, and a second annular wedge element 11, which is supported on piston 4, can be pushed into annular wedge element 10. The axial distance of displacement by which the two annular wedge elements 10 and 11 are displaceable relative to each other is limited by the height of the two annular wedge elements 10 and 11.

The first annular wedge element 10 rests against the inner circumference of outer tube 2 and is radially spreadable under the action of annular wedge element 11, which is insertable from the bottom. Such spreading takes place with plastic deformation of the abutting wall sections of outer tube 2.

Figure 2:
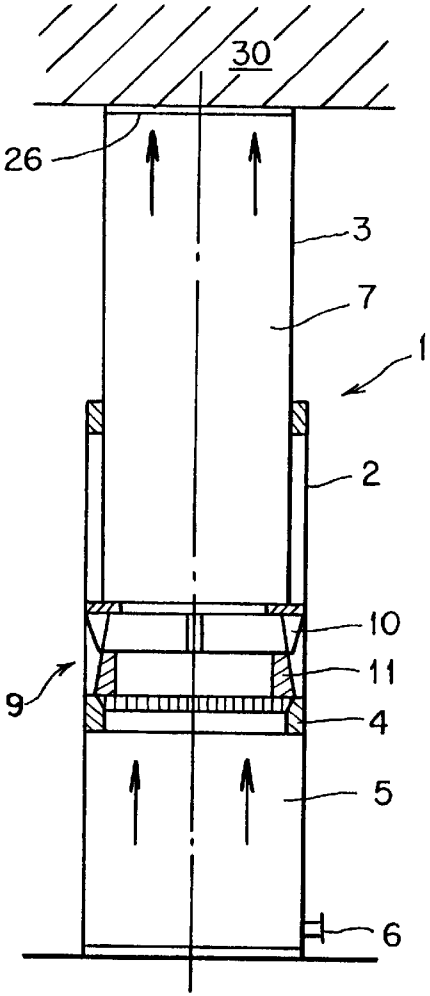
FIG. 2 shows the support of FIG. 1 during the setting process.
Figure 1:
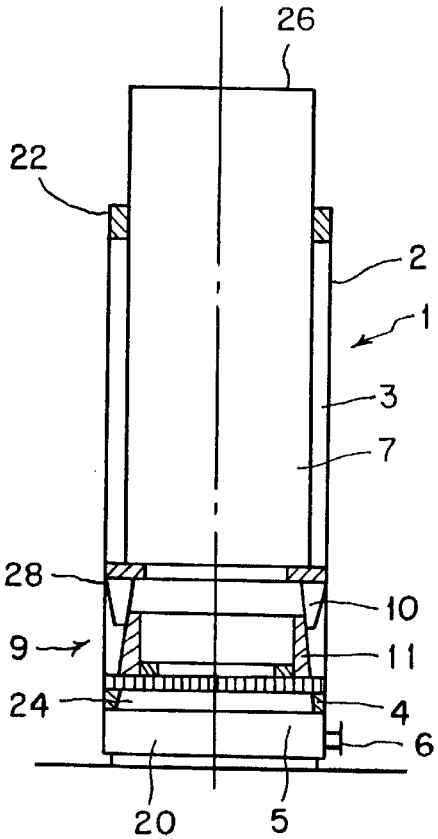
FIG. 1 shows a first embodiment of a support of the invention prior to the setting process.

The support according to FIGS. 1 to 4 operates as follows. As shown in FIGS. 1 and 2, a hydraulic fluid pressure medium, for example pressurized water, is first admitted via bottom chamber 5 and filling connection 6. The pressure medium causes piston 4 to displace inner tube 3 upwardly from outer tube 2 until the top end 26 of inner tube 3 touches upon the sheet of rock 30 to be supported and inner tube 3 comes to a stop.

When bottom chamber 5 is acted upon further, piston 4 now pushes annular wedge element 11 into annular wedge element 10 from the bottom as shown in FIG. 3. Thus the wedge element 10 expands in the radial direction and the outer tube 2 is deformed outwardly within the area which comes into contact with annular wedge element 10. Inner tube 3 is fixed on outer tube 2 by such deformation and can be pushed back only when the area of deformation of the wall of outer tube 2 is enlarged in the downward direction.

The drawing shows that the degree of deformation of outer tube 2 and thus the supporting force of the mechanical locking device 9 are predeterminable through design specifications. These design factors include the wall thickness of outer tube 2, the wedge angle of annular wedge elements 10 and 11, and the axial distance of displacement of annular wedge elements 10 and 11 relative to each other.

The present invention as described above shows, furthermore, that with the support of the invention, the mechanical locking device is activated by admitting pressure into bottom chamber 5, and that it is not dependent upon the penetration of the inner tube into the outer tube over a certain distance of displacement. Therefore, mechanical locking device 9 acts with full supporting force immediately after the setting process is completed, whereby such supporting force is determinable by design specifications.

Figure 4:
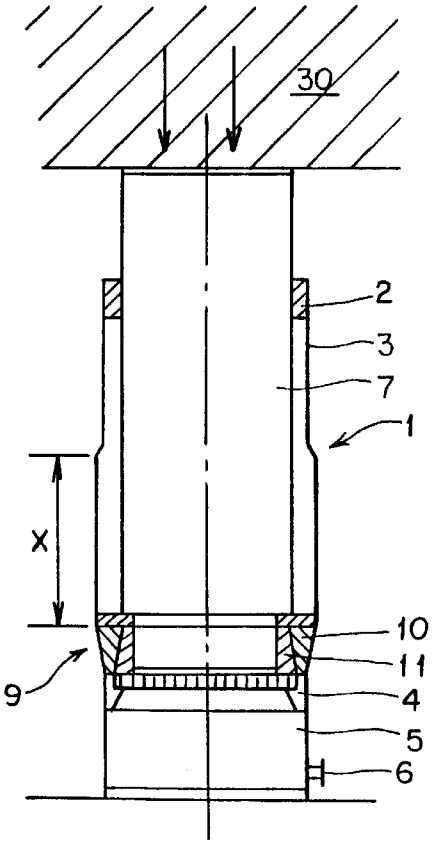

FIG. 4 shows, furthermore, that the high supporting load of mechanical device 9 is maintained even if the support sinks in, as caused by convergence and compaction of the sheets of rock to be supported. In this case the zone of deformation shifts in the downward direction, with the deformation resistance remaining the same over the entire distance of sinking-in. Thus the support carries the load over the entire distance of sinking-in with the same, very high supporting force. This process is illustrated in FIG. 4, where the path or distance of sinking-in (path of convergence and compaction) is denoted by "x".

Figure 6:
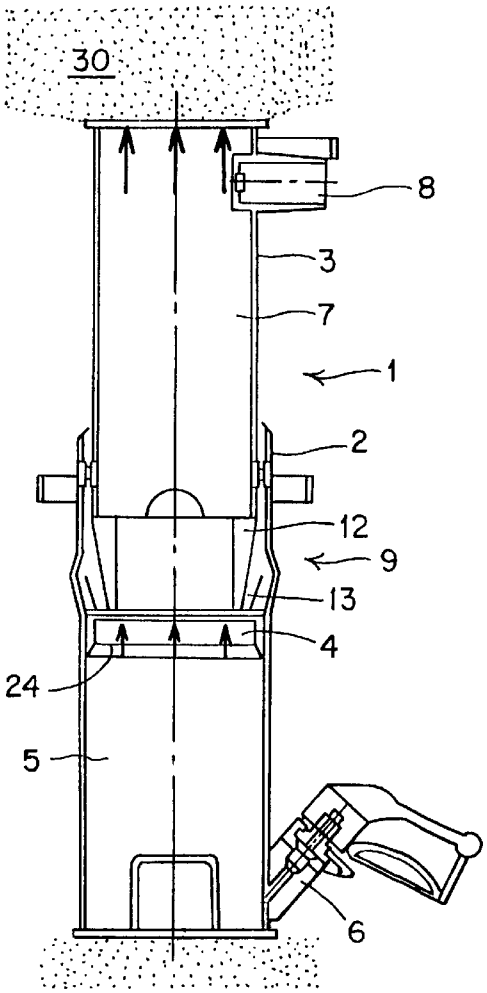
FIG. 6 shows the support of FIG. 5 during the setting process.
Figure 5:
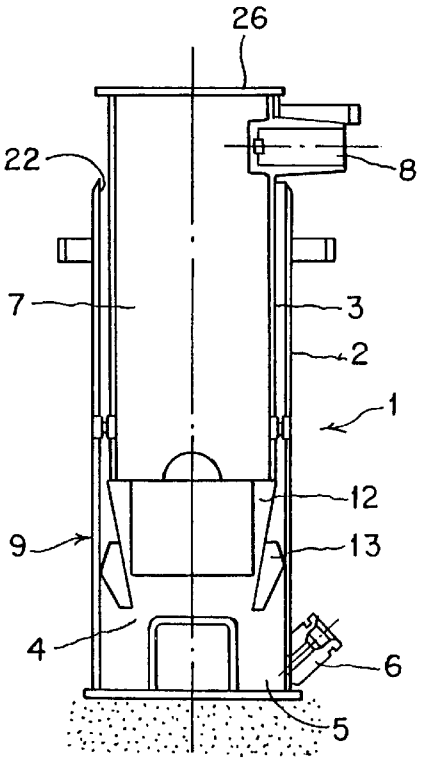
FIG. 5 shows a second embodiment of a support of the invention prior to the setting process.
Figure 7:
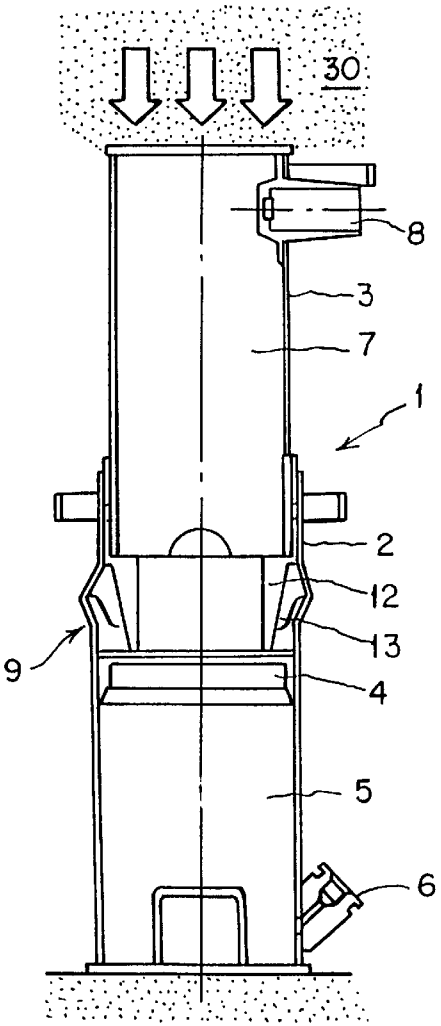
FIG. 7 shows the support of FIG. 6 following activation of the mechanical locking device.

In another embodiment shown in FIGS. 5 to 9, this substantially corresponds with the prior embodiment of FIGS. 1 to 4. Hence it is possible to use the same reference numerals for identical components. In the exemplified embodiment according to FIGS. 5 to 9, a first annular wedge element 12 is located at the bottom end 24 of inner tube 3. This annular wedge element 12 is insertable in a second annular wedge element 13, which in turn is supported on piston 4. Second annular wedge element 13 abuts on inner circumference 28 of the wall of outer tube 2 and is spreadable when outer tube 2 is deformed radially, as shown in FIG. 6. In this exemplified embodiment, annular wedge element 12 is about one third longer than annular wedge element 13. This means that the supporting force consequently increases when the load rises after the setting process is completed (FIG. 6). FIG. 7 shows that annular wedge element 12 is further displaced into annular wedge element 13 as the load increases, so that the plastic deformation of outer tube 2 increases accordingly. This additional absorption of load is visible on the outside on the support as well.

Figure 8:
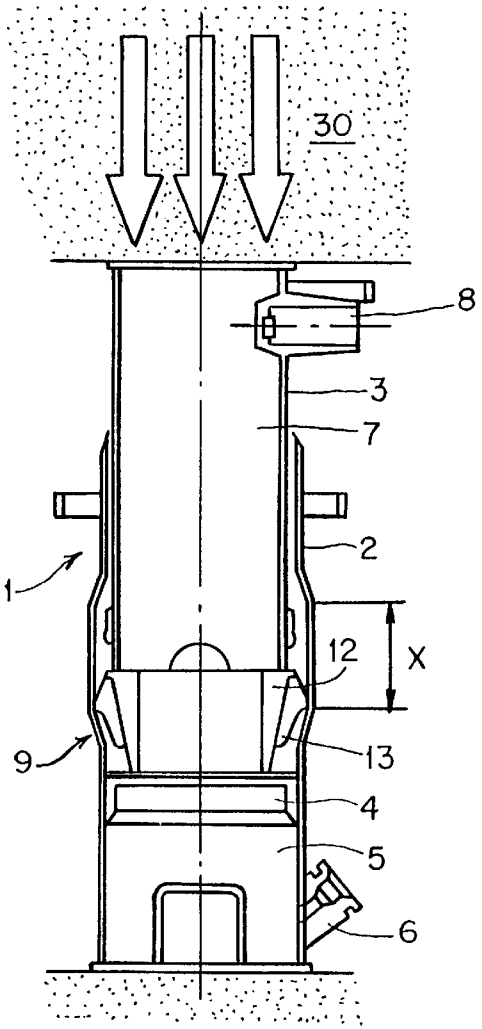

Now, when the load then increases further, the support sinks in with corresponding axial extension of the zone of deformation, as shown in FIG. 8. Length "x" of the path of convergence is visible here from the outside as well.

Figure 9:
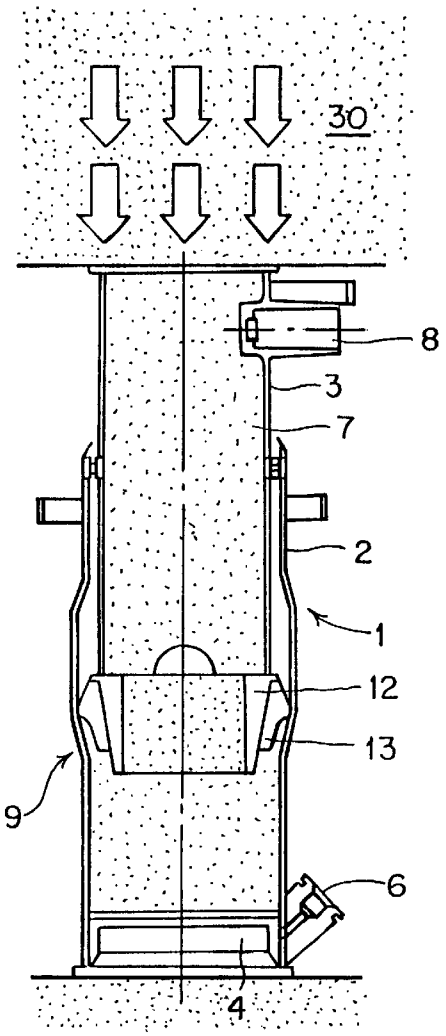
FIG. 9 shows filling of the support of FIG. 8 with construction material.

A special feature of the invention embodiment according to FIGS. 5 to 9 is that piston 4 is designed in the form of a flying structural component. That is piston 4 has no mechanical connection with inner tube 3. The result thereof is that piston 4, after admission of pressure to bottom chamber 5 has been completed, can be pushed down from top chamber 7 all the way to the bottom of the outer tube. This is shown in FIG. 9.

If need be, this permits filling the entire support over its total length with construction material for increasing the supporting force, namely from top chamber 7, i.e., from the inner tube 3 as shown in FIG. 9. For this purpose inner tube 3 may be provided at the top end with a filling connection means 8. This filling connection 8 may be initially provided on the support at the beginning. In a further embodiment, it can be provided later on the site where the support is employed, for example by drilling a hole in the inner tube with a suitable device and by connecting a filler 8 to such hole.

A special advantage of the invention is that filling with construction material can be practically carried out at any time. Thus the supporting force can be adapted to the requirements depending on the application conditions.

By selecting a filler with special physical properties and/or by filling the support wholly or partly it is possible to optimally adapt the characteristic values of the support within wide limits to the mechanical requirements of the rock to be supported.

Accordingly, while a few embodiments of the present invention have been shown and described, it is to be understood that many changes and modifications may be made thereunto without departing from the spirit and scope of the invention as defined in the appended claims.

What is claimed is:

1. A support for underground mining and tunnel construction, comprising an outer tube (2) and an inner tube (3) which are pushable into each other in a telescoping manner;

a piston (4) acted upon by a hydraulic pressure medium located in the outer tube and, upon admission of pressure, acts on the inner tube for extending the inner tube;

said outer tube and said inner tube are fixable on each other at any length of extension by means of a mechanical locking device;

said mechanical locking device (9) is positioned in a force-transmitting manner between the piston (4) and an inner end of the inner tube (3) and comprises an annular spreading-wedge type drive mechanism having two annular wedge elements (10, 11; 12, 13) axially pushable into each other over a limited distance of displacement;

one of said wedge elements being supported on the piston (4) and another wedge element being supported on a bottom end (24) of the inner tube (3); one of the annular wedge elements (10, 11; 12, 13) rests against an inner circumference (28) of the outer tube (2) and is radially spread at an end of an axial path of displacement of the two annular wedge elements (10, 11; 12, 13) relative to each other by wedge action of the annular spreading-wedge type drive mechanism in a manner such that abutting wall areas of the outer tube (2) are radially deformed outwardly.

2. The support according to claim 1, comprising means (8) for filling the inner tube (3) and the outer tube (2) with construction material, following activation of the mechanical locking device (9).

3. The support according to claim 2, wherein said piston (4) acting on the inner tube (3) comprises a flying structural component; and when the inner tube (3) is filled with construction material, said piston is pushed back up to the bottom end of the outer tube (2) by the pressure of the construction material filled in the inner tube (3).

4. The supporting according to claim 2, wherein said means for filling is a short filling pipe (8) at the top end (26) of the inner tube (3).

* * * * *

UNITED STATES PATENT AND TRADEMARK OFFICE

CERTIFICATE OF CORRECTION

PATENT NO. : 6,056,480
DATED : May 2, 2000
INVENTOR(S) : Theodor KOLK

It is certified that error appears in the above-indentified patent and that said Letters Patent is hereby corrected as shown below:

column 1, Item [63], after "5,921,718", change

"which is a continuation-in-part of application" to

--which is a 371 of --.

Signed and Sealed this

Twentieth Day of March, 2001

Nicholas P. Godici

*Attest:*

NICHOLAS P. GODICI

*Attesting Officer*

*Acting Director of the United States Patent and Trademark Office*